US011879315B2

(12) United States Patent
Rollins

(10) Patent No.: US 11,879,315 B2
(45) Date of Patent: Jan. 23, 2024

(54) LUBRICATOR CAP ASSEMBLY FOR PLUNGER RECHARGING INCLUDING SENSOR FOR PLUNGER ARRIVAL DETECTION

(71) Applicant: Antelope Developments, LLC, Farmington, NM (US)

(72) Inventor: Christopher Jyoti Rollins, Farmington, NM (US)

(73) Assignee: Antelope Developments, LLC, Farmington, NM (US)

( * ) Notice: Subject to any disclaimer, the term of this patent is extended or adjusted under 35 U.S.C. 154(b) by 0 days.

(21) Appl. No.: 17/746,439

(22) Filed: May 17, 2022

(65) Prior Publication Data

US 2022/0372853 A1 Nov. 24, 2022

Related U.S. Application Data

(60) Provisional application No. 63/191,170, filed on May 20, 2021.

(51) Int. Cl.
*E21B 37/06* (2006.01)
*E21B 43/12* (2006.01)
*E21B 47/008* (2012.01)

(52) U.S. Cl.
CPC ..... *E21B 43/121* (2013.01); *E21B 47/008* (2020.05)

(58) Field of Classification Search
CPC ..... E21B 43/121; E21B 37/045; E21B 37/04; E21B 37/06
See application file for complete search history.

(56) References Cited

U.S. PATENT DOCUMENTS 3,473,611 A * 10/1969 Gregston ..... E21B 27/02 166/310
5,634,522 A * 6/1997 Hershberger ..... E21B 47/009 166/372
7,654,314 B2 * 2/2010 Farris ..... E21B 43/121 166/263
7,870,899 B2 * 1/2011 Wilson ..... E21B 41/02 166/244.1
2005/0150658 A1 * 7/2005 Farris ..... E21B 43/121 166/310
2007/0039739 A1 * 2/2007 Wilson ..... E21B 33/068 166/105
2012/0323493 A1 * 12/2012 Wright ..... E21B 47/00 702/6

(Continued)

*Primary Examiner* — Kipp C Wallace
(74) *Attorney, Agent, or Firm* — Polsinelli PC; David R. Mika

(57) ABSTRACT

A device for controlling injection of treatment fluids in plunger lift systems includes a lubricator cap coupleable to a lubricator. The lubricator cap defines a fluid inlet coupleable to a fluid injection system. A sensor coupled to the lubricator cap detects arrival of a plunger within the lubricator a controller communicatively coupled to the sensor transmits an indicator corresponding to arrival of plunger to a fluid injection control system. In response, the fluid injection system injects fluid into the fluid inlet to recharge the plunger. In certain implementations, the sensor detects arrival of the plunger at the lubricator by detecting movement of a lubricator spring or a component of a lubricator spring, such as a spring follower.

20 Claims, 7 Drawing Sheets

(56) References Cited

U.S. PATENT DOCUMENTS

| | | | | |
|---|---|---|---|---|
| 2014/0305636 | A1* | 10/2014 | Paulet | E21B 43/082<br>166/372 |
| 2016/0341195 | A1* | 11/2016 | Roycroft | E21B 43/121 |
| 2017/0107800 | A1* | 4/2017 | Townsend | E21B 47/008 |

* cited by examiner

LUBRICATOR CAP ASSEMBLY FOR PLUNGER RECHARGING INCLUDING SENSOR FOR PLUNGER ARRIVAL DETECTION

CROSS-REFERENCE TO RELATED APPLICATIONS

This application is related to and claims priority under 35 U.S.C. § 119 from U.S. Provisional Application No. 63/191,170, filed May 20, 2021, titled "Lubricator Cap Assembly for Plunger Recharging Including Sensor for Plunger Arrival Detection," the entire contents of which are fully incorporated by reference herein for all purposes.

TECHNICAL FIELD

The present disclosure relates to plunger lift systems and, in particular, to systems for charging plungers in plunger lift systems.

BACKGROUND

In the recovery of oil from oil-bearing reservoirs, it is often possible to recover only a portion of the oil contained in the underground formation by the so-called primary recovery methods which utilize the natural forces present in the reservoir. Thus, a variety of enhanced recovery techniques (so-called secondary or tertiary recovery) have been employed in order to increase the recovery of oil from subterranean reservoirs. One approach to secondary and tertiary recovery includes the use of a plunger containing treatment fluids that is provided downhole to deliver the treatment fluids into the well. Such plunger operations require careful monitoring of the well and control of both delivery and recharging of the plunger. Accordingly, there remains a need for efficient and effective approaches to operating plunger lift systems.

SUMMARY

Aspects of the present disclosure include a device and system that include a lubricator cap defining a fluid inlet. The lubricator cap is coupleable to a lubricator and the fluid inlet is coupleable to a fluid injection system. The device further includes a sensor coupled to the lubricator cap for detecting arrival of a plunger within the lubricator. The device further includes a controller communicatively coupled to the sensor, such that, when the sensor detects arrival of the plunger, the controller transmits an indicator. When the indicator is received by the fluid injection system, the fluid injection system injects fluid into the fluid inlet. In at least certain implementations, the sensor detects arrival of the plunger by detecting movement of a lubricator spring of the lubricator.

Other aspects of the present disclosure are directed to a method of plunger lift that includes detecting arrival of a plunger within a lubricator using a sensor of a cap assembly coupled to the lubricator. The sensor detects arrival of the plunger by detecting movement of a lubricator spring. The method further includes transmitting an arrival indicator from a controller in communication with the sensor and in response to detecting arrival of the plunger. When the arrival indicator is received by a fluid injection system, the fluid injection system injects fluid into a fluid inlet of the cap assembly.

Figure 1:
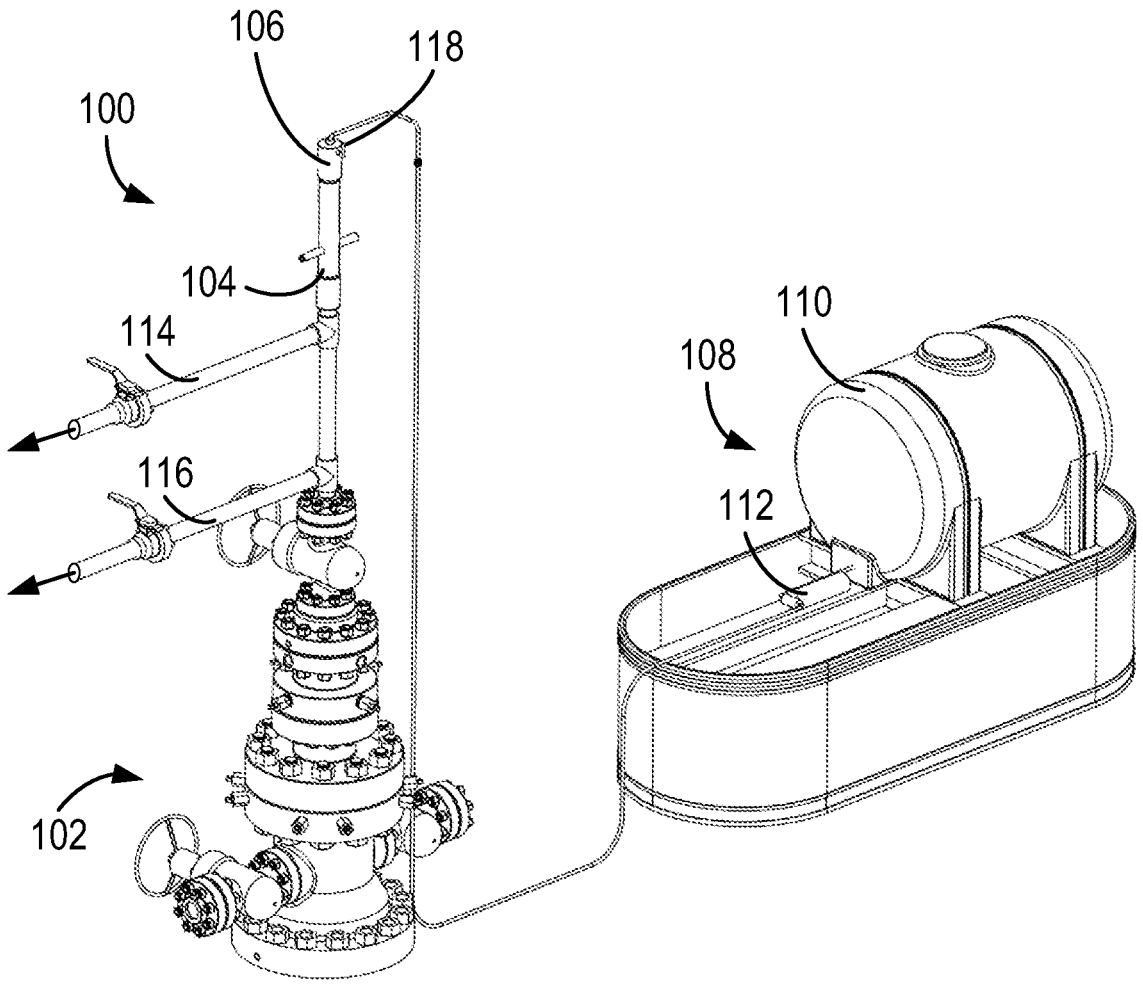
FIG. 1 is a perspective view of a plunger lift system according to the present disclosure.

Those skilled in the art will appreciate and understand that, according to common practice, various features and elements of the drawings described above are not necessarily drawn to scale, and that the dimensions of the various features and elements may be expanded or reduced to more clearly illustrate the embodiments of the present disclosure described therein.

DETAILED DESCRIPTION

Artificial lift systems, such as plunger lift systems, are a common tool for improving the life and productivity of oil and gas wells. Oil and gas wells produce not only oil and gas, but other less desirable fluids, such as water and condensates, that may be present in the surrounding formation or that may form in the well during production. In general, downhole fluids are produced and then processed to separate the valuable oil and gas components from the water and other fluids that may be present downhole. Production is facilitated by natural bottomhole pressure; however, as a well ages, bottomhole pressure and resulting production velocities may decrease, thereby impacting production of fluid from the well. If the pressure and velocity drop is significant, fluid (whether desirable oil and gas or byproducts of the production process) may gradually accumulate within the well, exacerbating the well's decline. To address this issue, artificial lift systems, such as plunger lift systems, may be used to unload heavier fluids (e.g., liquids) from the well, thereby reducing the effects of declining bottomhole pressure and extending the productive life and efficiency of the well.

Plunger lift is an established and efficient artificial lift technique that relies on the well's own energy to remove accumulated fluids and maintain gas flow rates. In general, a plunger lift system includes a plunger or piston that travels through the production tubing, and through any fluids within the tubing, to the bottom of the well (generally by gravity). A bottomhole bumper spring is installed within the well to stop the plunger at a particular location within the well. The plunger is generally designed to have sufficient clearance with the production tubing to allow the plunger to travel within the tubing string when a bypass valve of the plunger is open. However, when the bypass valve is closed (e.g., in response to the plunger contacting the bottomhole bumper spring), the plunger may form a seal between the production tubing and casing-tubing annulus.

Plunger lift is a cyclic process in which the plunger is alternately brought to the surface and allowed to fall back down the well to the bottomhole bumper spring. In general, while the plunger is disposed in a lubricator assembly of a wellhead with its bypass valve open, the well operator or well control system monitors production pressure and flow rate from the well. In response to a decline in production pressure/flow rate, the well operator or control system closes a surface/outlet valve, which generally stops flow from the well and permits the plunger to drop through the accumulated gas and liquid within the well tubing. When the plunger reaches the bottomhole bumper spring, the bypass valve of the plunger closes and the plunger seals the production tubing. As a result of this sealing, gas within the well begins to accumulate within the casing-tubing annulus and pressure within the annulus rises. When a target pressure is reached within the casing-tubing annulus, the surface/outlet valve is opened. In general, the target pressure is such that the pressure differential created when the surface/outlet valve is opened is sufficient to drive the plunger to the surface and renew flow from the well. When the plunger reaches the surface, it is received by a lubricator and the bypass valve is opened, thereby setting up a subsequent plunger lift cycle when well pressure drops and/or flow slows.

In addition to providing artificial lift, the plunger may also be used for other functions. For example, the plunger may be configured to scrape and remove deposits (e.g., paraffin or scale deposits) from within the production tubing and to transport the removed deposits to the surface. In other applications, the plunger may be used to deliver treatment fluids to the well. To do so, the plunger may include an internal chamber that is refilled when the plunger reaches the surface. As the plunger drops through the well and/or comes to rest at the bottomhole bumper spring, the treatment fluid within the chamber may exit into the production tubing, thereby delivering the treatment fluid to the production tubing. One example of a treatment fluid is a soap for reducing scale and paraffin and/or reducing the viscosity of fluids disposed within the well. In certain applications, the plunger may include valve mechanisms that, like the bypass valve, are actuated when the plunger reaches the bottomhole bumper spring to release the treatment fluid. In other applications, the plunger may be open and treatment fluid may exit the plunger as it descends into the wellbore. In such applications, the treatment fluid may generally be selected or adapted to be lighter than the wellbore fluid.

It should be understood that the foregoing discussion merely provides examples of plunger lift systems and that other plunger lift systems and techniques are fully considered to be within the scope of the present disclosure. For example, in certain plunger lift systems, the plunger may not include a bypass valve. Similar to the foregoing example, plungers without bypass valves still travel down the well when the well is shut in and ascend back to the surface in response to opening of a surface valve following sufficient downhole pressure buildup. Accordingly, and unless otherwise specified, it should be appreciated that the present disclosure is not limited to any specific plunger lift systems or components thereof (e.g., plungers) and that the concepts disclosed herein may be readily adapted to a range of plunger lift system applications. Stated differently, to the extent any specific plunger lift systems or plunger lift system component are discussed in this disclosure, such discussions should be considered as non-limiting examples.

As noted above, plunger lift systems are an important part of ensuring efficient and long-term production from oil and gas wells. Accordingly, there is a need for efficient systems and methods for performing plunger lift operations and, in particular, plunger lift operations including treatment fluid delivery.

FIG. 1 is a perspective view of an example plunger lift system 100 according to the present disclosure. As illustrated, the plunger lift system 100 includes a wellhead 102 that is generally coupled to a production tubing of a well and includes various valves and other components for controlling and monitoring flow from the production tubing. The wellhead 102 includes a lubricator 104 to which a lubricator cap assembly 106 is coupled. The lubricator cap assembly 106 is coupled to a fluid injection system 108 that includes a fluid source 110 (e.g., a tank) and a pump 112. The wellhead 102 further includes each of an upper outlet 114 and a lower outlet 116, each of which may generally feed into a common outlet line (not shown). The outlet line may include an outlet valve (e.g., a motor operated valve, not shown) that may be automatically opened and closed in response to corresponding signals received from a controller.

With the plunger in its bottomhole position and a target pressure achieved in the casing-tubing annulus, the outlet valve may be opened causing the plunger to rise through the production tubing, to enter into the wellhead 102, and to be received by the lubricator 104. As discussed below in further details, arrival of the plunger within the lubricator 104 is detected by a sensor (not visible in FIG. 1, but see, e.g., sensor 260 of FIG. 2) in the lubricator cap assembly 106. In response to detecting arrival of the plunger within the lubricator 104, a controller 118 coupled to the sensor generates and transmits an indicator that the plunger has arrived at the lubricator 104 to a control system associated with the fluid injection system 108. In response to receiving the indicator, the fluid injection system 108 provides fluid to the lubricator cap assembly 106, e.g., by activating the pump 112 to pump fluid from the fluid source 110 to the lubricator cap assembly 106. The fluid provided to the lubricator cap assembly 106 subsequently enters the plunger. The now-charged plunger remains in the lubricator 104 until a subsequent plunger cycle is initiated, e.g., by closing the outlet valve.

Additional indicators may be transmitted by the controller 118 to other systems for controlling well operations. For example, and without limitation, the controller 118 may transmit an indicator that the plunger has arrived at the lubricator to a well control system for purposes of controlling and/or synchronizing the outlet valve for a subsequent plunger lift cycle.

Figure 2:
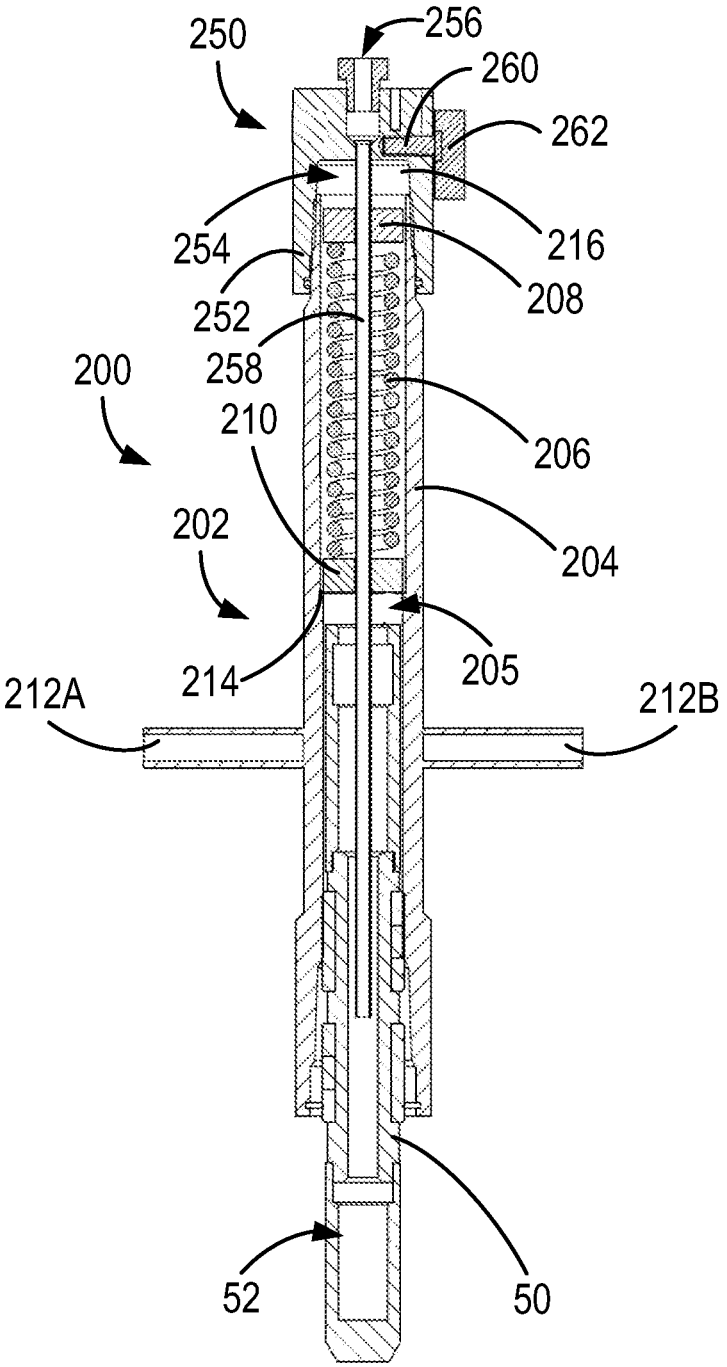
FIG. 2 is a cross-sectional view of a lubricator and cap assembly according to the present disclosure shown in a first configuration in which a plunger is disposed within the lubricator but has not triggered a sensor of the cap assembly.

FIG. 2 is a cross-sectional view of a first lubricator assembly 200. More specifically, FIG. 2 illustrates the lubricator assembly 200 as a plunger 50 is arriving within a lubricator 202 of the lubricator assembly 200.

The lubricator assembly 200 generally includes the lubricator 202, which, as illustrated in FIG. 1, may be coupled to a wellhead. The lubricator 202 includes a lubricator body 204 that defines a lubricator cavity 205. A spring 206 for absorbing the energy of the plunger 50 as it arrives from downhole is disposed within the lubricator cavity 205 and may include each of an upper spring follower 208 and a lower spring follower 210. As illustrated, the lubricator 202 further includes a pair of handles 212A, 212B to facilitate installation and transportation of the lubricator 202.

The lubricator assembly 200 further includes a lubricator cap assembly 250 that may be coupled to an upper end of the lubricator 202. The lubricator cap assembly 250 includes a lubricator cap 252 that defines a lubricator cap cavity 254 and a fluid inlet 256. A dip tube 258 may be coupled to the lubricator cap 252 and extend through the lubricator cap 252 such that, when the lubricator cap assembly 250 is coupled to the lubricator 202, the dip tube 258 extends into the lubricator body 204 and through the spring 206. The lubricator cap assembly 250 further includes a sensor 260 for detecting arrival of the plunger 50 within the lubricator 202 and a controller 262 coupled to the sensor 260. As discussed below in further detail, the sensor 260 generates an indicator when the plunger 50 arrives that is transmitted to the controller 262. The controller 262, in turn, transmits another indicator, e.g., to a fluid injection control system or a well control system, to initiate subsequent operations.

Arrival of the plunger 50 is generally detected by the sensor 260 based on movement of the spring 206. Such movement of the spring 206 is illustrated in the difference between FIG. 2 and FIG. 3, which is another cross-sectional view of the lubricator assembly 200. More specifically, FIG. 2 illustrates the spring 206 in a first position (e.g., a lower position) that generally reflects an absence of the plunger 50 at the lubricator 202. In the first position, the spring 206 may be supported by a lip or similar support surface 214 formed within the lubricator cavity 205. When the spring 206 is supported by the support surface 214, a clearance 216 is present above the spring 206 to permit travel of the spring 206. As illustrated, the clearance 216 generally corresponds to the lubricator cap cavity 254; however, in other embodiments, the lubricator cap cavity 254 may not be present and the clearance 216 may instead be an upper volume of the lubricator cavity 205.

Figure 3:
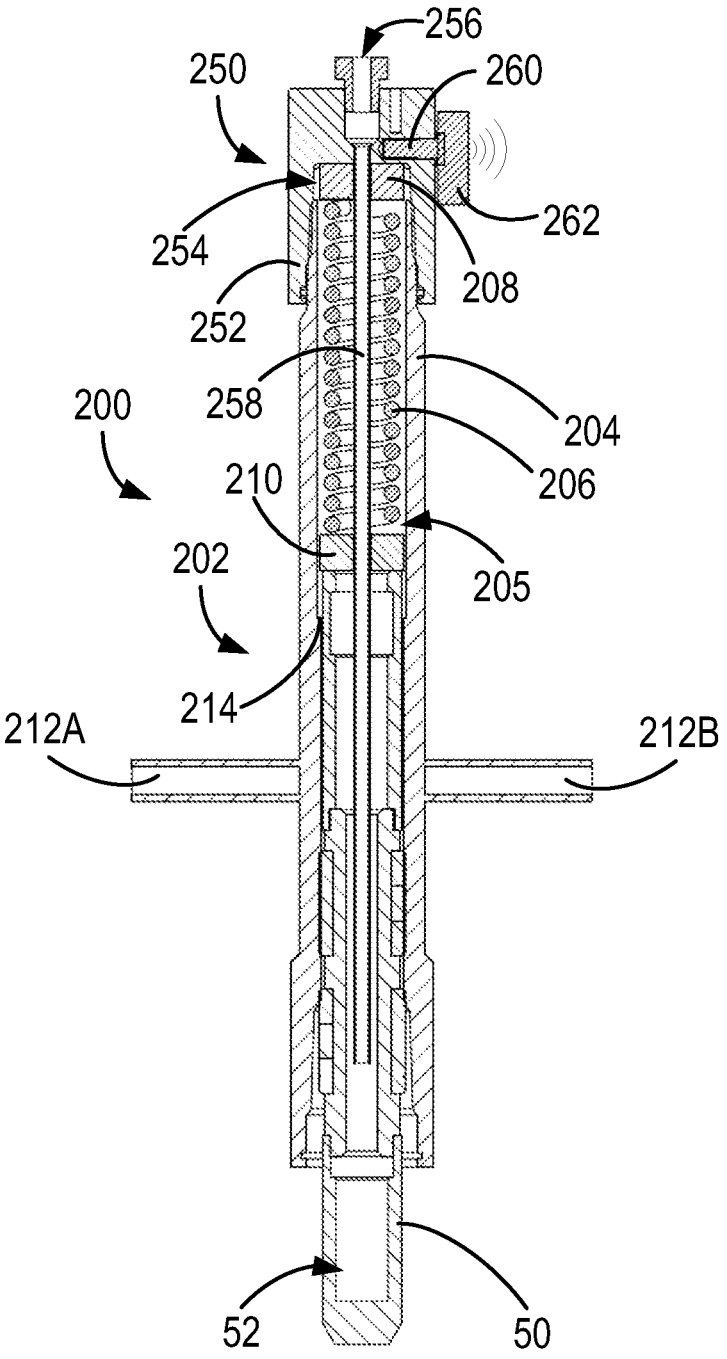
FIG. 3 is a cross-sectional view of the lubricator and cap assembly of FIG. 2 shown in a second configuration in which the plunger has arrived within the lubricator and triggered the sensor of the cap assembly.

FIG. 3 is another cross-sectional view of the lubricator assembly 200 of FIG. 2 and, more specifically a cross-sectional view of the lubricator assembly 200 with the spring 206 in a second position (e.g., an upper position) that generally results from arrival of the plunger 50 at the lubricator 202. More specifically, when the plunger 50 arrives within the lubricator 202, the plunger 50 contacts the spring 206. Such contact is generally sufficient to unseat the spring 206 from the support surface 214 and to drive an upper portion of the spring 206 (e.g., the upper spring follower 208) into the clearance 216 (shown in FIG. 2). The plunger 50 may further cause at least some compression of the spring 206 in addition to translating the spring 206. Although illustrated as being a helical spring with upper and lower followers, implementations of the present disclosure are not necessarily limited to such springs. Rather, any suitable spring, shock absorber, or similar element may be used alone or in combination with similar elements.

The sensor 260 and controller 262 of the lubricator cap assembly 250 are generally configured to detect arrival of the plunger 50 by detecting movement of the spring 206 or portions of the spring, such as the upper spring follower 208, into the clearance 216. For example, the sensor 260 and the controller 262 may be configured to detect movement of the spring 206 the into the second (e.g., upper position) illustrated in FIG. 3. In at least some implementations, the sensor 260 and the controller 262 may be more specifically configured to detect movement of the spring 206 form the first (e.g., lower) position illustrated in FIG. 2 into the second position illustrated in FIG. 3. In response to detecting arrival of the plunger 50, the controller 262 generates a corresponding indicator and transmits the indicator to one or more systems, such as a well control system or fluid injection control system.

As illustrated in FIGS. 2 and 3, the controller 262 is mounted on an exterior surface of the lubricator cap 252, is directly coupled to the sensor 260, and is configured to communicate wirelessly with other systems, such as a well control system or a fluid injection control system. In other embodiments, the controller 262 may be mounted elsewhere and may be configured to receive signals from the sensor 260 over a wired or wireless connection. Similarly, the controller 262 may be configured to communicate with another system (e.g., a well control system or a fluid injection control system) over either a wired or wireless connection and may communicate with the system through various intermediate devices.

In certain implementations, the plunger 50 may include an internal volume 52 and may be configured to deliver a treatment fluid downhole. In such implementations, arrival of the plunger 50 may trigger a fill operation. For example, the controller 262 may generate and transmit an indicator to a fluid injection control system (e.g., a control system of the fluid injection system 108 shown in FIG. 1) that causes the fluid injection system to inject fluid into the plunger 50. More specifically, the fluid injection system may be coupled to the fluid inlet 256 of the lubricator cap assembly 250 and may provide treatment fluid to the fluid inlet 256 in response to receiving the arrival indicator from the controller 262. Treatment fluid received at the fluid inlet 256 may then pass through the dip tube 258, which extends through the spring 206 and into the plunger 50 when the plunger is disposed within the lubricator 202, and into the internal volume 52 of the plunger 50.

Figure 4A:
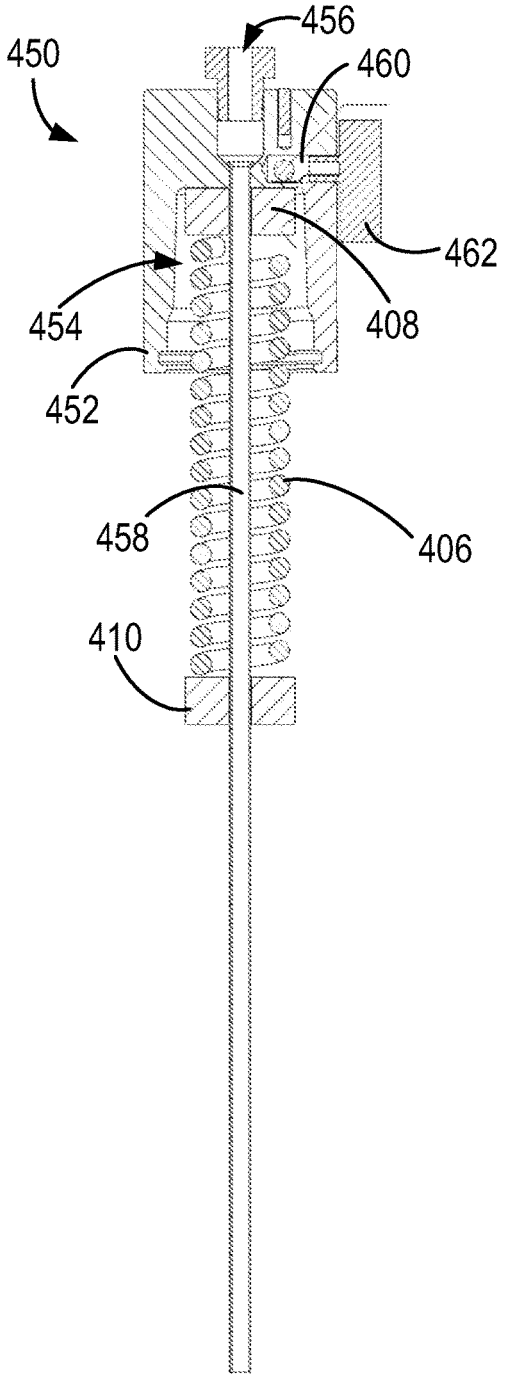
FIG. 4A is a cross-sectional view of a lubricator cap assembly according to the present disclosure including a magnetic sensor.
Figure 4B:
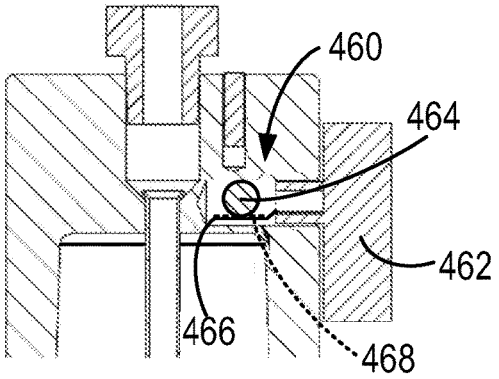
FIGS. 4B and 4C are detailed views of the lubricator cap assembly of FIG. 4A illustrating operation of the magnetic sensor.
Figure 4C:
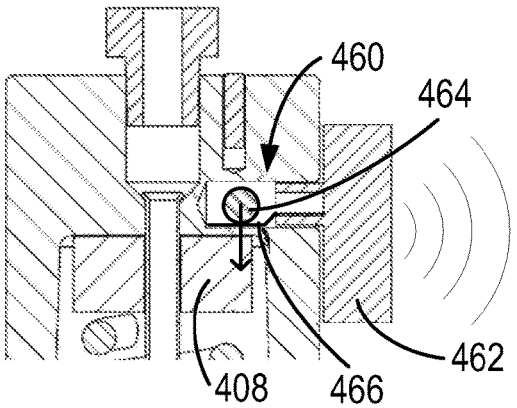

FIGS. 4A-4C illustrate an implementation of a lubricator cap assembly 450 according to the present disclosure that includes a magnetic sensor. More specifically. FIG. 4A is a cross-sectional view of the lubricator cap assembly 450 while FIGS. 4B and 4C are detailed views of the lubricator cap assembly 450 illustrating activation of a magnetic sensor 460 of the lubricator cap assembly 450. A spring 406 of a lubricator (not shown but for the spring 406) is also included for purposes of explaining operation of the sensor 460. As illustrated, the spring 406 includes each of an upper spring follower 408 and a lower spring follower 410.

The lubricator cap assembly 450 a lubricator cap 452 that defines a lubricator cap cavity 454 and a fluid inlet 456. A dip tube 458 may be coupled to the lubricator cap 452 and extend through the lubricator cap 452 such that, when the lubricator cap assembly 450 is coupled to a lubricator, the dip tube 458 extends through the spring 406 and into a body of the lubricator. As previously discussed, when a plunger arrives at the lubricator, the plunger contacts the spring 406 and causes the spring to translate upwards into the lubricator cap cavity 454 (or similar clearance area). The lubricator cap assembly 450 includes a sensor 460 and corresponding controller 462 for detecting arrival of the plunger within the lubricator and signaling arrival of the plunger to one or more control systems.

In the specific implementation of FIGS. 4A-4C, the sensor 460 is a magnetic sensor. As illustrated in FIGS. 4B and 4C, the magnetic sensor 460 may include a magnetic body 464 coupled to a flexible or movable arm 466. When the spring 406 is not disposed within the lubricator cap cavity 454, the arm 466 is biased such that the magnetic body 464 is maintained in a first position (as shown in FIG. 4B). As the spring 406 enters the lubricator cap cavity 454, the spring 406 or a portion thereof (such as the upper spring follower 408) formed of or including a ferromagnetic material, interacts with the magnetic body 464, applying a downward force to the magnetic body 464. The force on the magnetic body 464 moves the magnetic body into a second position (as shown in FIG. 4C) and moves and/or applies a strain to the arm 466. Movement or strain on the arm 466 may therefore be measured or detected to determine movement of the spring 406 and, as a result, arrival of the plunger within the lubricator. Alternatively, the spring 406 may include a magnet and the body 464 of the sensor 460 may be formed of a ferromagnetic material with substantially the same result of the body 464 moving in response to the spring 406 coming into proximity of the sensor 460.

Magnetic sensors are just one example of sensors that may be used in implementations of the present disclosure. More generally, implementations of the present disclosure may include any suitable sensor for measuring movement of a lubricator spring caused by arrival of the plunger at the lubricator. Various non-limiting examples of such sensors are described below with reference to FIGS. 5A-9B. The following examples are intended only as illustrative examples of sensors that may be used to detect movement of a lubricator spring and/or arrival of a plunger within a lubricator. The various sensors are illustrated as being incorporated into corresponding lubricator cap assemblies; however, the lubricator cap assemblies are illustrated in a simplified form that may omit certain structures and elements (e.g., a fluid inlet and a dip tube), discussed herein. Such omissions are intended only to simplify FIGS. 5A-9B and should not limit the illustrated lubricator cap assemblies.

In at least certain implementations of the present disclosure, the sensor of the lubricator cap assembly is generally adapted to measure movement of the lubricator spring within the lubricator caused by arrival of the plunger. Accordingly, any sensor suitable for detecting such movement or contact of the plunger and the lubricator spring may be used in implementations of the present disclosure. However, in at least certain implementations, the sensor of the lubricator may be in the form of a proximity sensor that detects arrival of the plunger based on a proximity of the lubricator spring (or a component thereof, such as a spring follower) to the sensor.

Although the magnetic sensor 460 is described above as including a magnetic body 464 coupled to an arm 466 that moves in response to magnetic interactions with the spring 406, in at least certain implementations, the magnetic sensor 460 may instead rely on a thin film resistive force sensor. For example, as indicated in FIG. 4B, a thin film force sensor 468 (shown in dotted lines) may be disposed on the arm 466 between the magnetic body 464 and the arm 466. In such implementations, arrival of the spring 406 (e.g., the upper spring follower 408) may result in a net force on the magnetic body 464 that is transferred to the thin film force sensor 468. Accordingly, by observing the output of the thin film force sensor 468 (e.g., using controller 462), the thin film force sensor 468 may be used as an alternative magnetism-based technique to detect movement of the spring 406 responsive to arrival of the plunger within the lubricator.

Figure 5A:
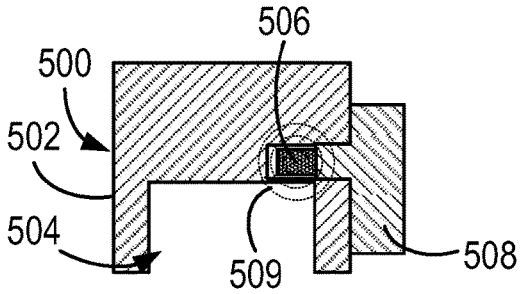
FIGS. 5A-9B are detailed cross-sectional views of lubricator cap assemblies including different sensor arrangements.
Figure 5B:
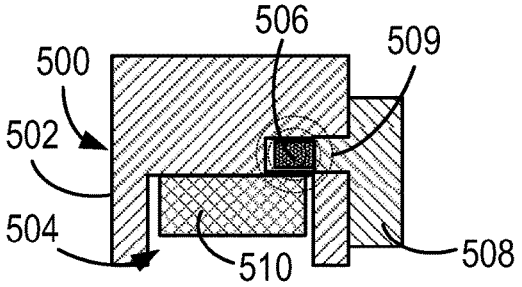

Referring first to FIGS. 5A and 5B, cross-sectional views of a first lubricator cap assembly 500 are provided. The lubricator cap assembly 500 may be coupled to a lubricator and generally includes a lubricator cap 502 defining a lubricator cap cavity 504. The lubricator cap assembly 500 further includes a sensor 506 communicatively coupled to a controller 508, which is generally configured to receive measurements or other indicators from the sensor 506 indicating arrival of a plunger at the lubricator and to communicate such indicators to a control system, such as a well control system or a fluid injection control system.

The sensor 506 of the lubricator cap assembly 500 is an inductive proximity sensor. An inductive sensor generally relies on electromagnetic induction to detect or measure objects. More specifically, the sensor 506 includes an oscillation circuit that generates a high frequency magnetic field 509. When a metallic object (e.g., a lubricator spring or a portion of the lubricator spring, such as an upper spring follower 510) approaches the magnetic field 509 (e.g., as shown in FIG. 5B), interaction between the magnetic field and the metallic object attenuates or stops oscillation of the magnetic field. By observing changes to the magnetic field, the sensor 506 may be used to detect the presence and proximity of metallic objects to the sensor 506 and, more specifically, whether the lubricator spring has translated upward in response to arrival of the plunger within the lubricator. Accordingly, in certain implementations of the present disclosure, the sensor 506 and the controller 508 may be configured to detect and to communicate arrival of the plunger within the lubricator based on inductive interactions between the spring and sensor 506.

Figure 6A:
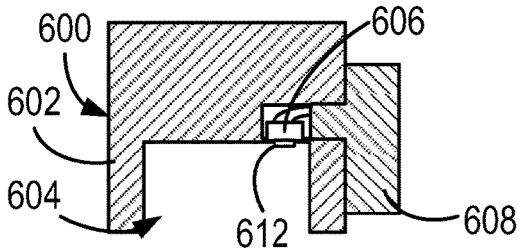
Figure 6B:
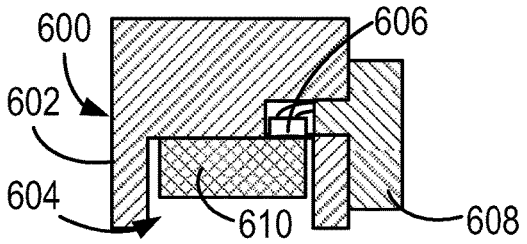

FIGS. 6A and 6B are cross-sectional views of a second lubricator cap assembly 600. The lubricator cap assembly 600 may be coupled to a lubricator and generally includes a lubricator cap 602 defining a lubricator cap cavity 604. The lubricator cap assembly 600 further includes a sensor 606 communicatively coupled to a controller 608, the sensor 606 being in the form of a mechanical switch. In general, the sensor 606 is arranged such that a switch plunger 612 or similar element extends into the lubricator cap cavity 604. When the plunger arrives within the lubricator and causes upward translation of the lubricator spring, the lubricator spring (or a portion thereof, such as an upper spring follower 610) depresses the switch plunger 612, closing the mechanical switch of the sensor 606. Accordingly, in certain implementations of the present disclosure, the sensor 606 and controller 608 may be configured to detect movement of the lubricator spring caused by arrival of the plunger based on mechanical interactions between the sensor 606 and the spring.

Figure 7A:
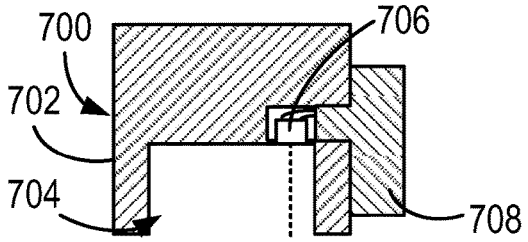
Figure 7B:
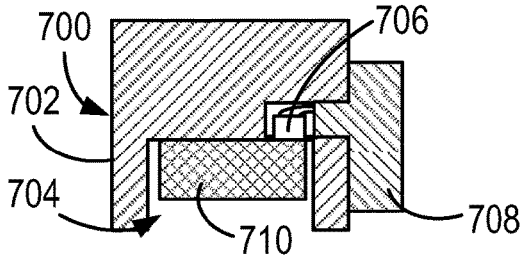

FIGS. 7A and 7B are cross-sectional views of a third lubricator cap assembly 700. The lubricator cap assembly 700 may be coupled to a lubricator and generally includes a lubricator cap 702 defining a lubricator cap cavity 704. The lubricator cap assembly 700 further includes a sensor 706 communicatively coupled to a controller 708, the sensor 706 being in the form of an optical proximity sensor. In general, the sensor 706 is arranged such that the sensor 706 detects the distance to the spring or a component of the spring, such as an upper spring follower 710. For example, the optical proximity sensor may generate an infrared or similar beam and use the beam to measure distance to the upper spring follower 710. When the plunger arrives within the lubricator and causes upward translation of the lubricator spring, the distance measured by the optical sensor 706 to the spring/spring follower may be reduced, thereby signaling arrival of the plunger. Accordingly, in certain implementations of the present disclosure, the sensor 706 and controller 708 may be configured to detect movement of the lubricator spring cause by arrival of the plunger based on optical measurements.

Figure 8A:
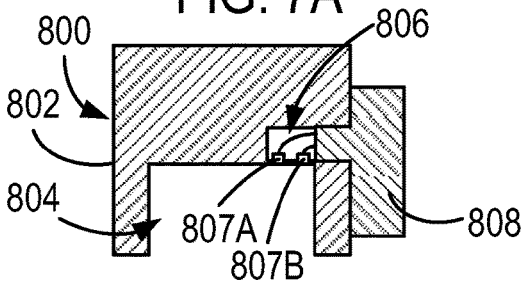
Figure 8B:
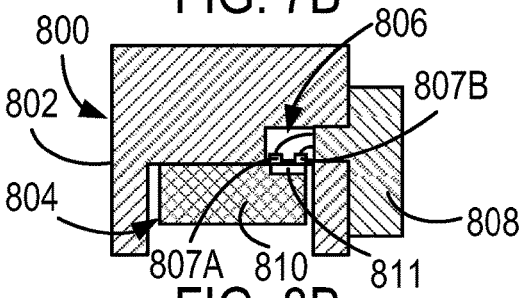

FIGS. 8A and 8B are cross-sectional views of a fourth lubricator cap assembly 800. The lubricator cap assembly 800 may be coupled to a lubricator and generally includes a lubricator cap 802 defining a lubricator cap cavity 804. The lubricator cap assembly 800 further includes a sensor 806 communicatively coupled to a controller 808, the sensor 806 being in the form of an electrical proximity switch. In general, the sensor 806 is arranged such that a pair of contacts 807A, 807B are exposed within the lubricator cap cavity 804. The spring, or a component of the spring, such as an upper spring follower 810, may in turn be formed of a conductive material or include a conductive element, such as a contact pad 811. When the plunger arrives within the lubricator and causes upward translation of the lubricator spring, the contact pad 811 connects the contacts 807A, 807B, thereby completing a circuit of the sensor 806, and indicating arrival of the plunger within the lubricator. Accordingly, in certain implementations of the present disclosure, the sensor 806 and controller 808 may be configured to detect movement of the lubricator spring caused by arrival of the plunger based on establishing an electrical connection.

Figure 9A:
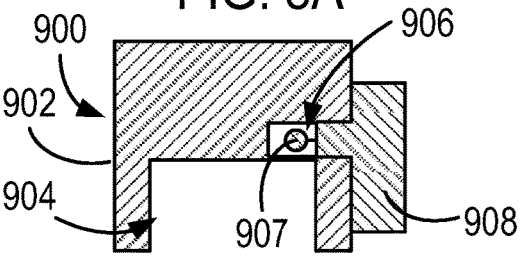
Figure 9B:
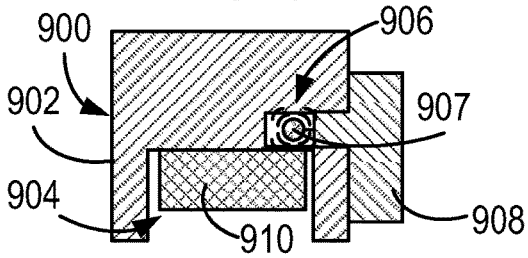

FIGS. 9A and 9B are cross-sectional views of a fifth lubricator cap assembly 900. The lubricator cap assembly 900 may be coupled to a lubricator and generally includes a lubricator cap 902 defining a lubricator cap cavity 904. The lubricator cap assembly 900 further includes a sensor 906 communicatively coupled to a controller 908, the sensor 906 being in the form of a vibration sensor or other sensor (e.g., an accelerometer) suitable for measuring vibration. In general, the sensor 906 is coupled to the lubricator cap 902 such that a vibration sensing element 907 of the sensor 906 is responsive to vibrations induced in the lubricator cap 902. Such vibrations may be caused, for example, by the plunger contacting the lubricator spring or the lubricator spring (or a component thereof, such as an upper spring follower 910) contacting the lubricator cap 902 after arrival of the plunger. Accordingly, in certain implementations of the present disclosure, the sensor 806 and controller 808 may be configured to detect movement of the lubricator spring caused by arrival of the plunger based on establishing an electrical connection.

The foregoing examples generally include measuring a change of position of a spring or spring follower to identify arrival of the plunger at the lubricator. In certain implementations, the change in position itself may be used to determine arrival of the plunger independent of time. Stated differently, arrival of the plunger may be identified based on a displacement of the plunger as measured using the sensor and controller of the lubricator cap assembly. In other implementations, arrival of the plunger may also be determined by considering changes in the position of the plunger over time as measured by the sensor and controller. Stated differently, instead of or in addition to displacement, velocity and/or acceleration of the plunger may also be used by the sensor and controller to determine arrival of the plunger at the lubricator.

Figure 10:
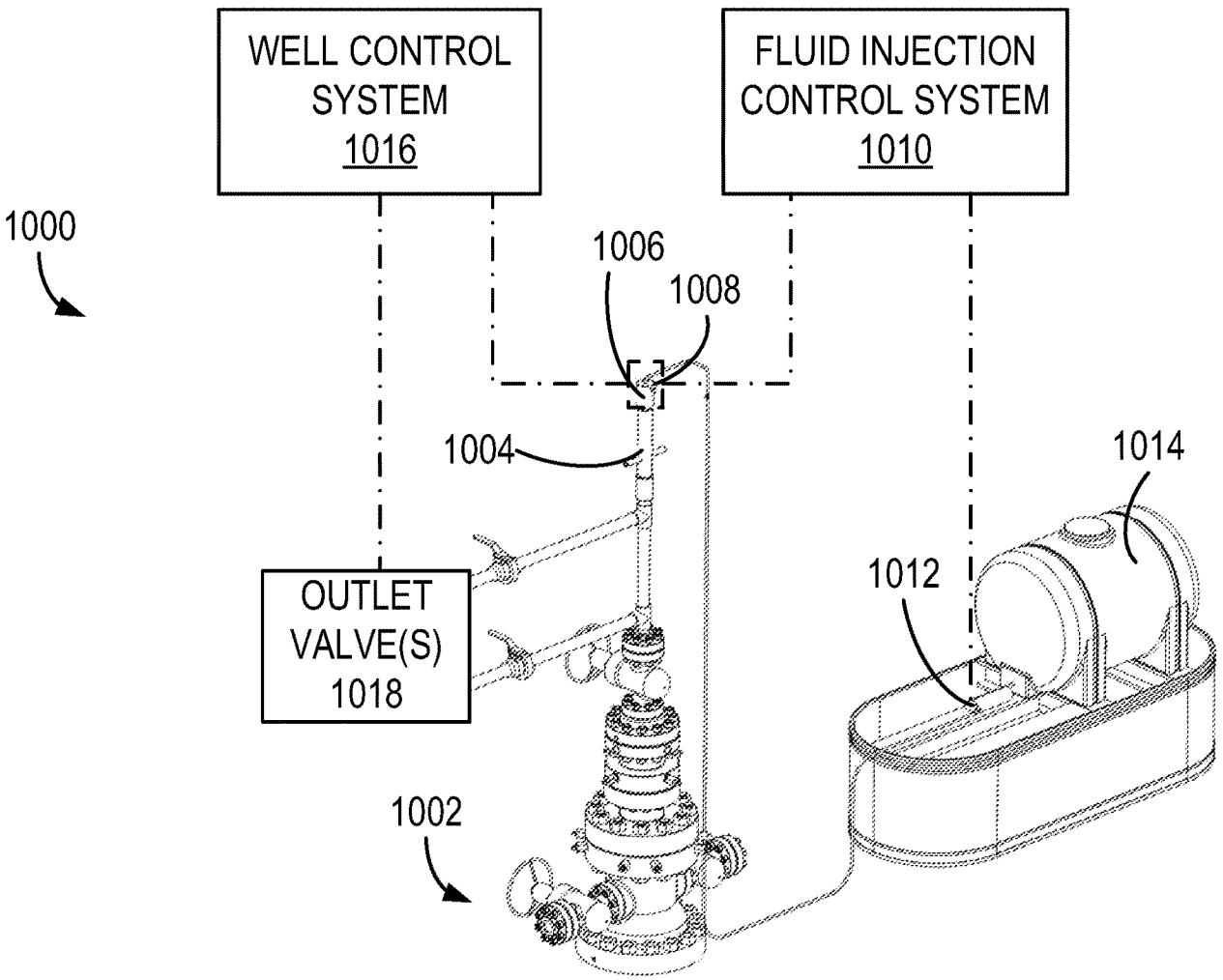
FIG. 10 is a schematic diagram illustrating communication for a plunger lift system according to the present disclosure.

FIG. 10 is a schematic diagram of an operating environment 1000 illustrating communication between various systems for purposes of coordinating a plunger lift operation. The environment 1000 includes a wellhead 1002 that further includes a lubricator 1004 and a lubricator cap assembly 1006 in accordance with the present disclosure. The lubricator cap assembly 1006 includes a sensor (not shown) for detecting arrival of a plunger within the lubricator 1004 and a controller 1008 communicatively coupled to the sensor.

During operation, when the sensor and controller 1008 detect arrival of a plunger within the lubricator 1004, the controller 1008 may generate and transmit an indicator corresponding to the arrival of the plunger. In certain implementations, the controller 1008 may transmit the indicator for receipt by a fluid injection control system 1010. In response to receiving the indicator from the controller 1008, the fluid injection control system 1010 may activate a pump 1012 to deliver a treatment fluid from a treatment fluid source 1014 to a fluid inlet of the lubricator cap assembly 1006. As previously discussed, such fluid may then be delivered to an internal cavity of the plunger to recharge the plunger.

As further illustrated in FIG. 10, the controller 1008 may also generate and transmit an indicator to a well control system 1016. The well control system 1016 may be a general control system that includes the fluid injection control system 1010 or may be separate from the fluid injection control system 1010 and configured to control other well operations. For example, in at least one implementation, the well control system 1016 may receive plunger arrival indicators from the controller 1008 to coordinate actuation and timing of one or more outlet valves 1018. More generally, however, the well control system 1016 may use plunger arrival indicators received from the controller 1008 to monitor operations, actuate and/or control components, generate log data, or perform other similar functions related to the corresponding well.

The indicator generated and transmitted by the controller 1008 may be in various forms provided that the fluid injection control system 1010 is capable of receiving and responding to the indicator. In certain implementations, the indicator may be an analog or digital signal transmitted over a wire from the controller 1008 to the fluid injection control system 1010. In another embodiment, the indicator may be in the form of a data packet transmitted over a wire or wirelessly to from the controller 1008 to the fluid injection control system 1010. Indicators according to this disclosure may also be non-electrical (e.g., pneumatic or hydraulic impulses). Moreover, indicators generated and transmitted by the controller 1008 may include supplemental or additional data beyond simply indicating arrival of the plunger 50. For example, controller 1008 may provide a timestamp or similar data in addition to indicating arrival of the plunger 50. As yet another example, the controller 1008 may be in communication with one or more other well sensors and may act as a bridge for those other sensors by receiving and forwarding data received from the other sensors to the fluid injection control system 1010 or to other similar systems, such as the well control system 1016.

Figure 11:
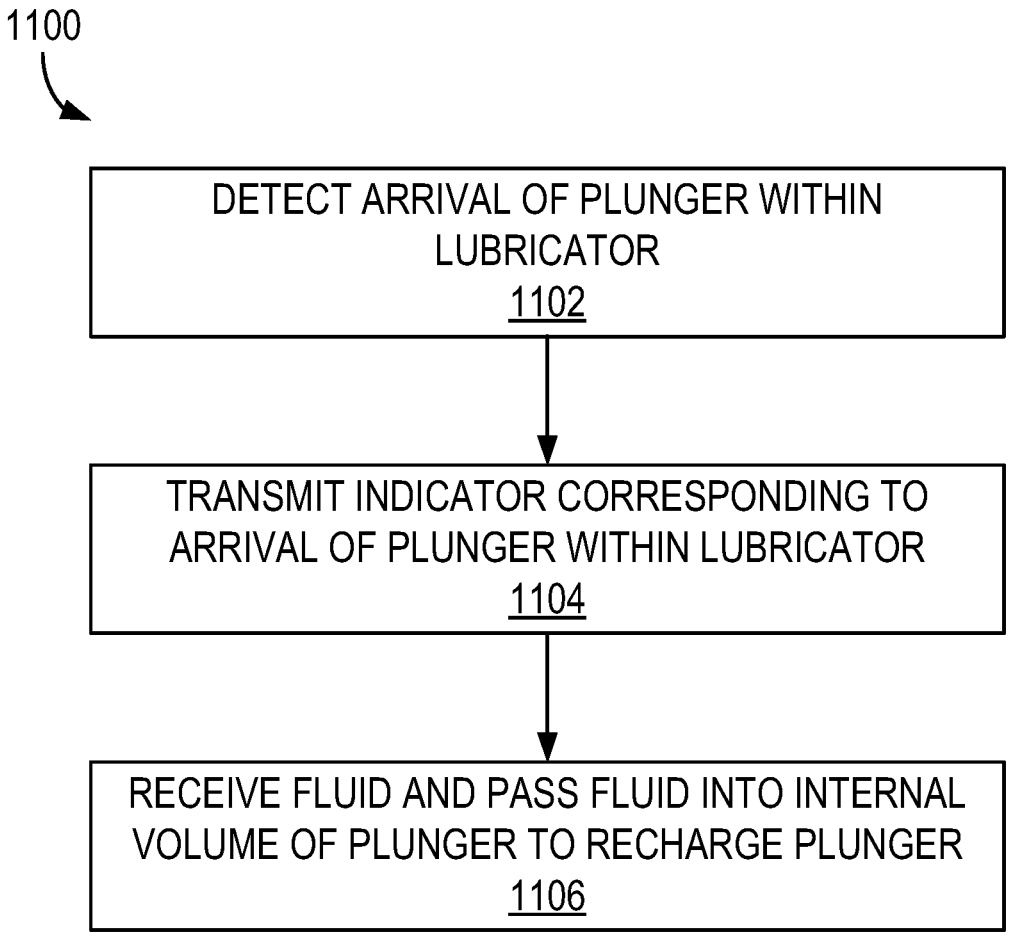
FIG. 11 is a flow chart illustrating an example method of operating a plunger lift system according to the present disclosure.

FIG. 11 is a flow chart illustrating a method 1100 for performing plunger lift. At operation 1102, a sensor of a lubricator cap assembly coupled to a lubricator detects arrival of a plunger within the lubricator. In certain implementations, arrival of the plunger may include detecting movement of a lubricator spring or a portion of a lubricator spring, such as a spring follower. As previously discussed, such detection may be accomplished using a variety of different sensors including, but not limited to, magnetic sensors, mechanical switches, electric switches/contacts, optical sensors, vibration sensors, inductive sensors, and the like.

At operation 1104, a controller in communication with the sensor transmits an indicator corresponding to arrival of the plunger within the lubricator. The indicator transmitted by the controller is generally configured such that, when the indicator is received by a fluid injection system, the fluid injection system injects fluid into a fluid inlet of the lubricator cap assembly. As discussed herein, such fluid may then pass through a dip tube or similar structure of the lubricator cap assembly and into an internal cavity of the plunger, thereby recharging the plunger with the fluid (operation 1106).

In at least certain implementations, the indicator may further be received by a well control system and be used by the well control system to control other well components. For example, in at least certain implementations, the indicator may be used by the well control system to actuate, time, or otherwise control an outlet valve of a wellhead.

As indicated above, aspects of the present disclosure have been described herein in terms of preferred embodiments and methodologies considered by the inventor to represent the best mode of carrying out the invention. It will be understood by the skilled artisan, however, that a wide range of additions, deletions, and modifications, both subtle and gross, may be made to the illustrated and exemplary embodiments of the lubricator cap assembly without departing from the spirit and scope of the invention. These and other revisions might be made by those of skill in the art without departing from the spirit and scope of the invention that is constrained only by the following claims.

What is claimed is:

1. A device, comprising:

a lubricator cap comprising a fluid inlet though an upper end of the lubricator cap, wherein the lubricator cap is coupleable to a lubricator containing a spring assembly disposed within the lubricator, the spring assembly including a lubricator spring and a spring follower, the spring follower disposed between the lubricator spring and the lubricator cap, the spring assembly configured to translate within the lubricator, wherein the fluid inlet is coupleable to a fluid injection system;

a sensor coupled to the lubricator cap for detecting arrival of a plunger within the lubricator by detecting translation of the spring assembly; and a controller communicatively coupled to the sensor, wherein, when the sensor detects arrival of the plunger, the controller transmits an arrival indicator, and wherein, when the arrival indicator is received by the fluid injection system, the fluid injection system injects fluid into the fluid inlet.

2. The device of claim 1, wherein the sensor is a magnetic sensor configured to detect translation of the spring follower based on a magnetically induced force applied to the sensor resulting from the spring follower being in proximity to the sensor.

3. The device of claim 1, wherein the sensor is an inductive sensor configured to detect translation of the spring follower by measuring a change in a magnetic field resulting from the spring follower being in proximity to the sensor.

4. The device of claim 1 further comprising a dip tube coupled to the fluid inlet, wherein, when the lubricator cap is coupled to the lubricator, the dip tube extends into the lubricator and, wherein, when the plunger arrives within the lubricator and the lubricator cap is coupled to the lubricator, the dip tube extends into the plunger.

5. The device of claim 1, wherein, when the sensor detects arrival of the plunger, the controller transmits a second arrival indicator, and wherein, when the second arrival indicator is received by a well control system, the well control system initiates an actuation operation of an outlet valve.

6. The device of claim 1, wherein the controller is mounted on an exterior surface of the lubricator cap.

7. The device of claim 1 further comprising the lubricator.

8. The device of claim 1, wherein the sensor is configured to detect arrival of the plunger by detecting translation of the spring follower resulting from translation of the spring assembly.

9. The device of claim 1, wherein the spring follower is an upper spring follower and the spring assembly further includes a lower spring follower disposed on an opposite end of the lubricator spring from the upper spring follower, the lower spring follower configured to be impacted by and transmit force from the plunger to the spring assembly.

10. A method of plunger lift comprising:

detecting arrival of a plunger within a lubricator using a sensor of a cap assembly coupled to the lubricator, wherein the sensor detects arrival of the plunger by detecting translation of a spring assembly translatable within the lubricator, the spring assembly including a spring and a spring follower, the spring follower disposed within the lubricator between a spring and the cap assembly; and transmitting an arrival indicator from a controller in communication with the sensor and in response to detecting arrival of the plunger, wherein, when the arrival indicator is received by a fluid injection system, the fluid injection system injects fluid into a fluid inlet through an upper end of the cap assembly.

11. The method of claim 10, wherein the sensor is a magnetic sensor configured to detect translation of the spring follower based on a magnetically induced force applied to the sensor resulting from the spring follower being in proximity to the sensor.

12. The method of claim 10, wherein the sensor is an inductive sensor configured to detect translation of the spring follower by measuring a change in a magnetic field resulting from the spring follower being in proximity to the sensor.

13. The method of claim 10 further comprising transmitting a second indicator, wherein, when the second indicator is received by a well control system, the well control system initiates a valve closure operation for an outlet line.

14. The method of claim 10 further comprising:

receiving the fluid from the fluid injection system at the fluid inlet; and providing the fluid into the plunger.

15. A plunger lift system comprising:

a lubricator containing a spring assembly disposed within the lubricator and including a lubricator spring and a spring follower, the spring follower disposed between the lubricator spring and a lubricator cap, the spring assembly configured to translate within the lubricator;

the lubricator cap coupled to the lubricator and defining a fluid inlet through an upper end of the lubricator cap, wherein the fluid inlet is coupleable to a fluid injection system;

a sensor coupled to the lubricator cap for detecting arrival of a plunger within the lubricator by detecting translation of the spring assembly; and a controller communicatively coupled to the sensor, wherein, when the sensor detects arrival of the plunger, the controller transmits an arrival indicator, and wherein, when the arrival indicator is received by the fluid injection system, the fluid injection system injects fluid into the fluid inlet.

16. The plunger lift system of claim 15 further comprising further comprising a dip tube coupled to the fluid inlet, wherein the dip tube extends into the lubricator and, wherein, when the plunger arrives within the lubricator, the dip tube extends into the plunger.

17. The plunger lift system of claim 15, further comprising the fluid injection system, wherein the fluid injection system is coupled to the fluid inlet of the lubricator cap.

18. The plunger lift system of claim 15, wherein the sensor is a proximity sensor and detects arrival of the plunger based on proximity of the spring follower to the proximity sensor.

19. The plunger lift system of claim 15, wherein the sensor is configured to detect arrival of the plunger by detecting translation of the spring follower resulting from translation of the spring assembly.

20. The plunger lift system of claim 15, wherein the spring follower is an upper spring follower and the spring assembly further includes a lower spring follower disposed on an opposite end of the lubricator spring from the upper spring follower, the lower spring follower configured to be impacted by and transmit force from the plunger to the spring assembly.

* * * * *